United States Patent [19]

Spademan

[11] Patent Number: 4,928,405

[45] Date of Patent: May 29, 1990

[54] SHOE DYNAMIC FITTING SYSTEM

[76] Inventor: Richard G. Spademan, P.O. Box 6410, Incline Village, Nev. 89450

[21] Appl. No.: 871,733

[22] Filed: Jun. 6, 1986

Related U.S. Application Data

[63] Continuation-in-part of Ser. No. 751,828, Jul. 5, 1985, which is a continuation-in-part of Ser. No. 461,832, Jan. 28, 1983, abandoned, which is a continuation-in-part of Ser. No. 50,436, Jun. 20, 1979, Pat. No. 4,494,324, which is a continuation-in-part of Ser. No. 886,946, Mar. 15, 1978, Pat. No. 4,382,342.

[51] Int. Cl.[5] ..... A43B 23/26

[52] U.S. Cl. ..... 36/50; 36/54

[58] Field of Search ..... 36/117–121, 36/54, 72 R, 128, 129, 114

[56] References Cited

U.S. PATENT DOCUMENTS

| | | | |
|---|---|---|---|
| 3,657,827 | 4/1972 | Rieker | 36/117 X |
| 3,722,112 | 3/1973 | Morgan | 36/121 |
| 4,406,073 | 9/1983 | Spademan | 36/119 |
| 4,447,968 | 5/1984 | Spademan | 36/119 X |
| 4,534,122 | 8/1985 | MacPhail | 36/119 X |

FOREIGN PATENT DOCUMENTS

| | | | |
|---|---|---|---|
| 1947823 | 4/1971 | Fed. Rep. of Germany | 36/128 |
| 2354723 | 1/1978 | France | 36/54 |
| 57028 | 3/1911 | Switzerland | 36/72 R |
| 484643 | 3/1970 | Switzerland | 36/119 |
| 22873 | 1/1901 | United Kingdom | 36/128 |

*Primary Examiner*—Werner H. Schroeder
*Attorney, Agent, or Firm*—Townsend and Townsend

[57] ABSTRACT

A sport shoe comprising a lower tongue for engaging a foot pivotably secured to an upper tongue for engaging a leg and a tightening member coupled to the upper tongue. The tightening member extends forwardly from the upper tongue to overlay and movably engage the lower tongue to dynamically tighten and loosen the fit of the tongue on the foot as the upper tongue is moved.

24 Claims, 3 Drawing Sheets

SHOE DYNAMIC FITTING SYSTEM

RELATED PATENT APPLICATIONS

The present application is a Continuation-In-Part of applicant's application Ser. No. 751,828, filed July 5, 1985 which is a Continuation-In Part of applicant's application Ser. No. 461,832, filed Jan. 28, 1983 now abandoned which was a Continuation-In-Part of applicant's application Ser. No. 50,436, filed June 20, 1979 now U.S. Pat. No. 4,494,324 which was a Continuation-In-Part of patent application Ser. No. 886,946, filed Mar. 15, 1978 now U.S. Pat. No. 4,382,342.

BACKGROUND OF THE INVENTION

Sport shoes such as walking, running, tennis, basketball or soccer shoes, as well as skates, ski boots and the like must fit tightly on the user's feet. During certain maneuvers, with a running shoe during the support phase, heel strike and toe-off, for example, the tightness of the fit needs to be greater than during other times such as during the airborne phase or during the support phase midstance when the forces transmitted between the foot and the ground via the shoe are not as severe. In court and contact sport shoes, the tightness of the fit needs to be greatest when the largest forces are being applied between the shoe and the playing surface such as when changing direction. In the past, it was typical to tighten the shoe as much as possible, and physically bearable, to prevent or at least minimize relative movement of the foot in the shoe at times when maximal forces were transmitted between the playing surface and the shoe. As a practical matter, such a fit is excessively tight during most other times and quite frequently is uncomfortable, can lead to numbness, and in extreme cases, can even result in injuries. Thus, a compromise is frequently reached by tightening the shoe on the foot more than is necessary for the small forces that are applied and less than is desired to prevent relative movement of the foot in the shoe when large forces are applied. Consequently, the fit of such shoes is almost always other than what it should be.

This problem has been recognized in the past in connection with ski boots where the exerted forces are especially large and the required tightness of the fit for extreme maneuvers is typically unbearable for any length of time. Thus, this inventor has developed dynamic fitting systems which temporarily increase the tightness of the fit of the boot in response to certain skiing maneuvers, for example, by constructing the ski boot so that the tightness of the fit of the boot, or at least a portion of the boot increases in response to a forward lean of the skier. U.S. Pat. No. 4,360,979, entitled A SPORT SHOE WITH A DYNAMIC ADJUSTABLE CUFF ASSEMBLY, and U.S. Pat. No. 4,426,796, entitled A SPORT SHOE WITH A DYNAMIC FITTING SYSTEM, describe such dynamic fitting systems.

In many respects, ski boots present a particular problem because it is one of their objectives to significantly limit the mobility of the user's ankle joint. For practical purposes, the skier's leg is movable in only a forward direction and even this movement is greatly limited compared with the anatomical freedom of movement provided by the ankle joint. Further, ski boots are large, relatively bulky and have thick walls to provide the desired strength, rigidity and heat insulation. Consequently, there is ample space within which to build a system to tighten the boot in response to a particular movement, e.g. forward flex of the leg relative to the foot.

Up to now, little or no consideration has been given to the relative tightness of sport shoes, particularly lightweight, highly mobile sport shoes such as running, tennis, soccer shoes and the like. The lightness of such sport shoes and the lack of an adequate analysis of the interaction between the sport shoe and the user's foot led to the practice of simply tightening the shoe to suit the user's taste, feel or preference. In some instances, the shoe might be too loose and not infrequently, slip significantly relative to the foot in a particular strenuous maneuver such as a sudden change in direction in turning. This was considered an inevitable adjunct to participating in sports.

Upon closer analysis, however, it becomes apparent that there are distinct phases in the use of a sport shoe when forces applied by the foot to the shoe momentarily greatly exceed the normally encountered forces. In running, for example, when the runner places his weight on the forefoot just prior to the airborne phase when lifting the foot off the ground, there are significant forces which tend to push the foot in a rearward direction relative to the shoe. Conversely, during heel stride when beginning the support phase, that is when the foot contacts the ground at the end of a strike, there are forces generated by both the runner's weight and the deceleration of the foot which tend to move the foot in a forward direction relative to the shoe. Such movements may be relatively small, say in the order of no more than a few millimeters, but they are present and typically, they are repeated thousands of times during a single run. This can lead to discomfort, skin irritation from rubbing between the floor and the shoe and energy losses which though small are highly undesirable, particularly in competitive sports. The problem is magnified in contact-type team sports where the forces can be significantly greater than those encountered during running, for example. Up to now, no solution to this problem has been available.

SUMMARY OF THE INVENTION

The present invention greatly reduces or eliminates the movement of the foot in a sport shoe by increasing the tightness of the fit on the foot as a function of the forward flex of the leg relative to the foot. At the same time, the tightness of the fit can be reduced when the foot is in its unweighted condition or airborne phase when minimum forces are exerted to prevent discomfort or possible injury from an overtightening of the shoe for excessive lengths of time. In particular, the present invention increases the tightness of the fit when the leg is flexed forwardly relative to the foot immediately prior to foot strike and throughout midstance and at toe-off resulting in the tightening of the shoe in the hindfoot, midfoot and forefoot.

Broadly speaking, therefore, the present invention provides a sport shoe forming a comfortable close fit on the foot of the lower extremity when the foot is off the playing surface and there is relative rearward flexion of leg or plantar flexion of the foot relative to the leg. The tightness of the fit is increased when the leg is placed in a relative forward or dorsiflexed condition relative to the foot. This is accomplished with means for sensing a relative flexion of the leg relative to the foot and means operatively coupled with the sensing means and the shoe for increasing the tightness of the fit of the shoe on the foot in response to a relative forward flexion of the leg relative to the foot. This system can be directly incorporated in a sport shoe and in such an instance forms an integral part thereof. Alternatively, this system can be provided in the form of a kit that is adapted to be placed into a conventional sport shoe which converts such a shoe into one having the above-discussed characteristics.

One embodiment of the invention provides that the sensing means be defined by an upper tongue, a lower tongue and a wedge-shaped tightening member operatively connected to the upper and lower tongue that moves forwardly relative to the lower tongue when the upper tongue is flexed forwardly relative to the lower tongue. The lower tongue and tightening member are positioned between the conventional sport shoe cutout lacing and the instep of the foot so that movement of the tightening member in a forward and upward direction increases the distance between the lace and the foot increasing the tightness of the shoe on the foot. This tightness is a function of the shape of the tightening member wedge and the degree of forward movement of the leg relative to the foot or dorsiflexion of the foot relative to the leg.

In another embodiment of the invention, the lower tongue and tightening member are connected to the lace such that forward movement of the tightening member relative to the lower tongue causes relative shortening of the lace. This causes the lace eyelets in the shoe upper sides adjacent the cutout to be drawn closer together increasing the tightness of the shoe on the foot.

In a running shoe, therefore, the tightness of the fit is increased during playing surface contact or the support phase when a foot is relatively dorsiflexed and the tightening member is in a relative forward position. Depending on the individual's running style, the degree of plantar flexion and dorsiflexion of the foot may vary during different phases of heel strike, midstance and toe-off. Adjustment of the tightening member can be accomplished to accommodate for these variations. Consequently, during those moments when large forces are transmitted from the foot to the ground via the shoe, the shoe fits the tightest, thereby reducing or eliminating movement of the foot in the shoe.

To summarize, therefore, the present invention provides a dynamic fitting system for a sport shoe which allows a reduced tightness unweighted condition for the foot when the tightness of the fit is at a minimum and which increases the tightness in response to forward flexion movement of the leg toward the foot. This greatly enhances the utility of the sport shoe in that it is tightest on the foot when the foot is in the support phase on the playing surface which is the condition in which maximum forces are transmitted between the foot and the shoe. Due to the tightness of the fit, relative movement between the foot and the shoe is minimized or eliminated. This increased tightness, improves stability and reduces heat formation and energy loss. Yet, the discomfort and possibility of injury which would accompany the use of a shoe tightened to take into account maximum forces, which are encountered for only fractions of a second are eliminated, because when the foot is in its relatively unweighted condition, or any position which deviates therefrom by a minor amount, the fit of the shoe can be such as to cause no discomfort whatsoever.

DESCRIPTION OF THE PREFERRED EMBODIMENT

Figure 1:
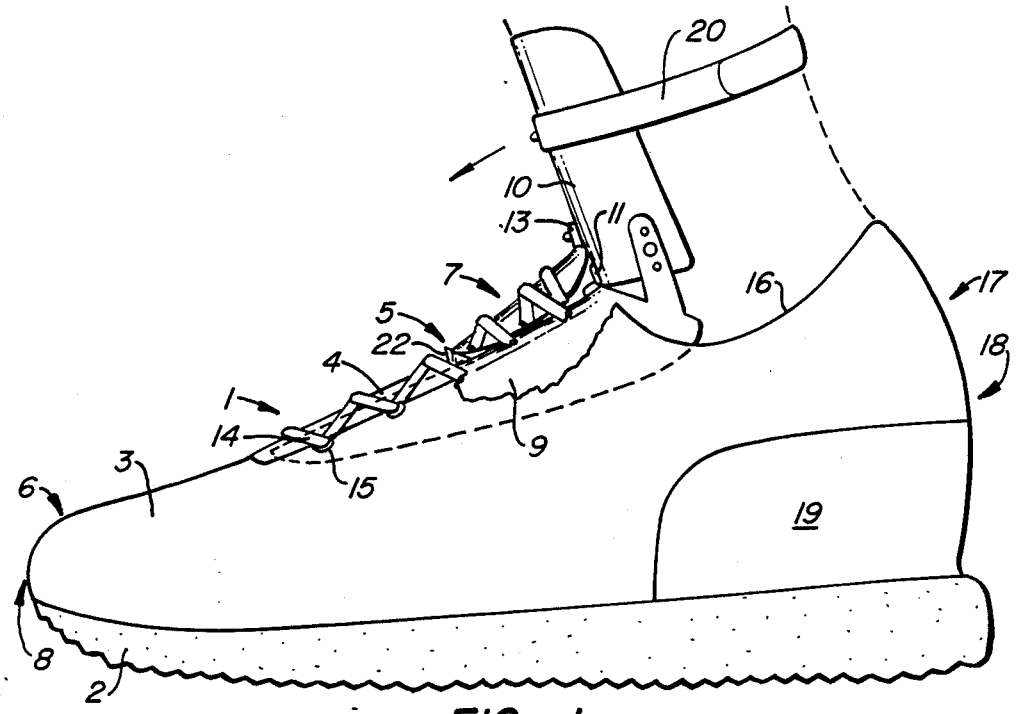
FIG. 1 is a side elevational view of a shoe provided with a dynamic fitting system in a forward flexed position constructed in accordance with the present invention.
Figure 2:
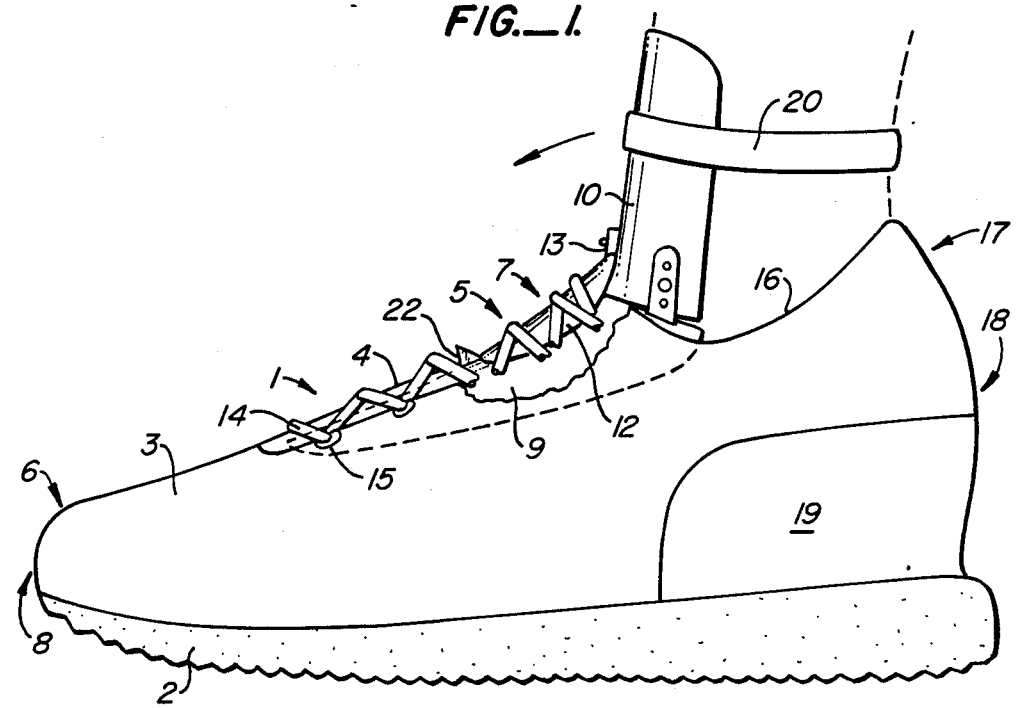
FIG. 2 is a side elevational view of the shoe of FIG. 1 with a dynamic fitting system in a rearward flexed position.
Figure 3:
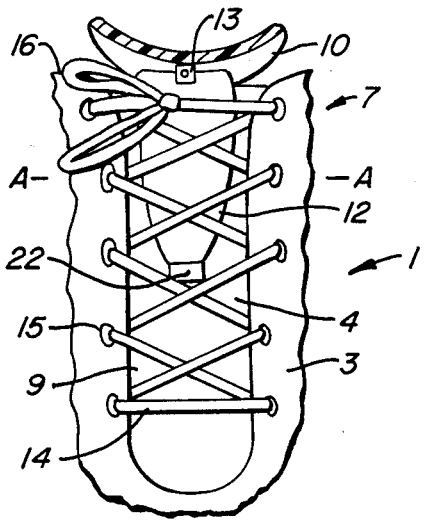
FIG. 3 is a partial top view of the shoe of FIG. 1.
Figure 5:
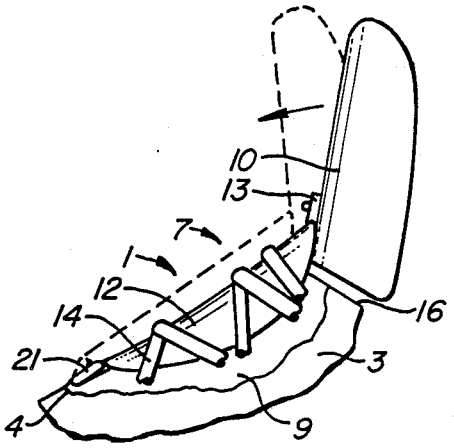
FIG. 5 is a partial side elevational view of the shoe of FIG. 1 showing a pivotable plate member.
Figure 4:
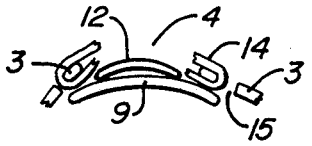
FIG. 4 is a cross-sectional view taken along line A—A of FIG. 3.

Referring to FIGS. 1-5, a shoe 1 such as a running shoe has a lower sole 2 constructed of a resilient material such as an elastomer and an upper shell 3 constructed of a flexible material such as leather or nylon secured to the lower sole and defining the inside of the shoe within which the user places his foot. The upper shell of the shoe includes a conventional, typically V-shaped cutout 4 above the midfoot 5 and extending generally from about the instep 7 of the midfoot 5 towards the toe end 8 of the shoe 1. A lower tongue 9 which overlies the foot underlies the cutout and is secured to an upper tongue 10, which overlies the lower leg at tongue hinge 11. Overlying the lower tongue 9 is a tightening member 12 secured to the upper tongue 10 by an adjustable tightening member hinge assembly 13. Hinge assembly 13 may consist of a hook on the upper tongue and multiple slots in the tightening member. Alternatively, the tightening member 12 may be hinged to the lower tongue at its forward end for sliding engagement with the upper tongue at its upper end. The V-shaped cutout 4 may be closed by a shell lace 14 passing through eyelets 15 arranged in the conventional manner. The upper shell 3 is further defined by a cuff 16 which is usually located below the user's ankle joint. The upper shell terminates in a heel end 17 which surrounds and engages the user's hindfoot 18 and which includes a heel counter 19. A releasable strap 20 may be adjustably secured by a Velcro strip or the like around the upper tongue 10 and leg to assist in forward and rearward movement of the upper tongue and tightening member 12. An optional pivotable member 21 may be pivotably coupled to lower tongue 9 and tightening member 12 to increase the distance between the tightening member 12 and lower tongue 9 when tightening member 12 is in the forward position increasing the tightness of the fit on the shoe as shown by the dashed line in FIG. 5. Alternatively, a wedge shaped member 22 may be secured to the lower tongue to engage the tightening member as shown in FIGS. 1–3.

In use, a foot is initially placed inside the shoe 1 in a plantar flexed position and the shell lace 14 adjusted and tied in a conventional manner to provide a close fit on the foot, with the tightening member in the rearward position, and to prevent loosening of the fit from the close fit condition. When the user forward flexes her/his-leg relative to the foot, the tightening member 12 moves in a forward and upward direction causing relative tightening of the shoe on the foot by increasing the tightness of the lace on the shell.

Figure 6:
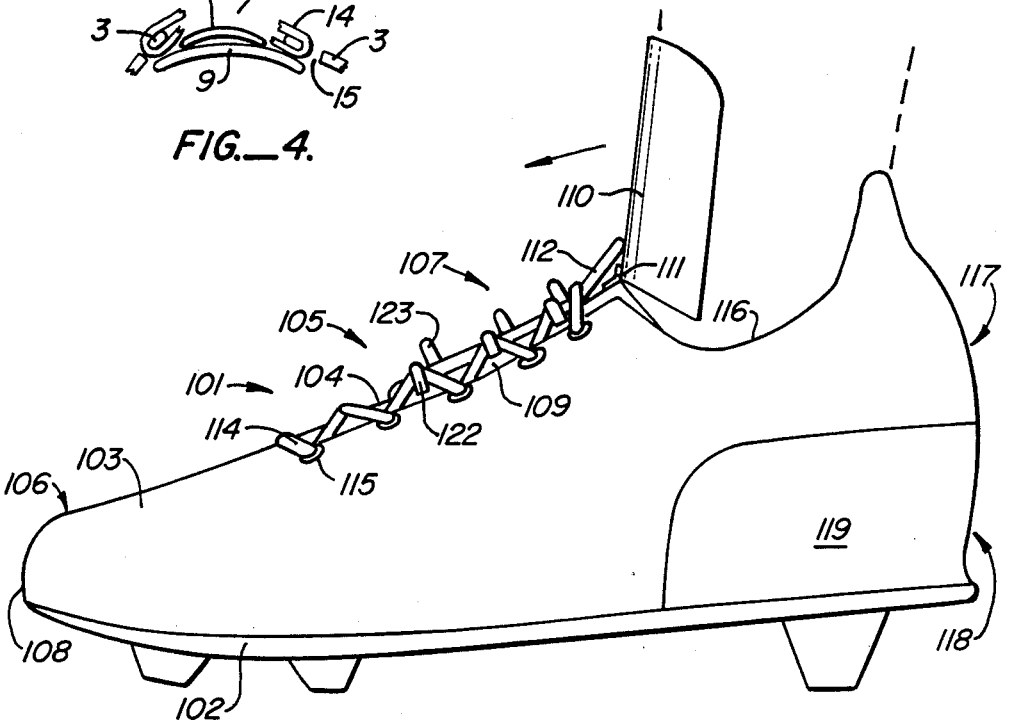
FIG. 6 is a side elevational view of a shoe including a dynamic fitting system constructed in accordance with another embodiment of the present invention.
Figure 7:
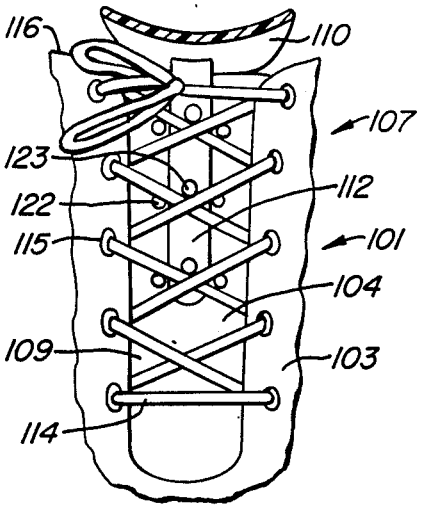
FIG. 7 is a partial top view of the shoe of FIG. 6.

Referring to FIGS. 6 and 7, a shoe 101 such as a soccer shoe has a lower sole 102 constructed of a semi-rigid material such as leather and an upper shell 103 constructed of a flexible material such as leather or nylon secured to the lower sole and defining the inside of the shoe within which the user places her/his foot. The upper shell of the shoe includes a conventional, typically V-shaped cutout 104 above the midfoot 105 and extending generally from about the instep 107 of the midfoot 105 towards the toe end 108 of the shoe 101. A lower tongue 109 which overlies the foot underlies the cutout and is secured to an upper tongue 110, which overlies the leg, at tongue hinge 111. Overlying the lower tongue 109 is a tightening member 112 which is slidably coupled with the upper tongue 110 at the rearward end of tightening member 112. The V-shaped cutout may be closed by a shell lace 114 passing through eyelets 115 arranged in the conventional manner. The upper shell 103 is further defined by cuff 116 which is usually located below the user's ankle joint. The upper shell terminates in a heel end 117 which surrounds and engages the user's hindfoot 118 and which includes a heel counter 119. Multiple lower tongue hooks 122 are secured to the lower tongue 109 forward to the adjacent lace 114. Multiple tightening member hooks 123 are secured to the tightening member 112 rearward to the adjacent lace 114.

In use, a foot is initially placed inside the shoe 101 in a plantar flexed position and the shell lace 114 is adjusted and tied to provide a close fit on the foot with the tightening member in the rearward position, and to prevent a loosening of the foot from the close fit condition. When the user forward flexes her/his leg relative to the foot, the tightening member 112 moves in a forward direction causing relative shortening of the lace and narrowing of the cutout. Thus, the tightness of the shell on the foot is increased.

Figure 8:
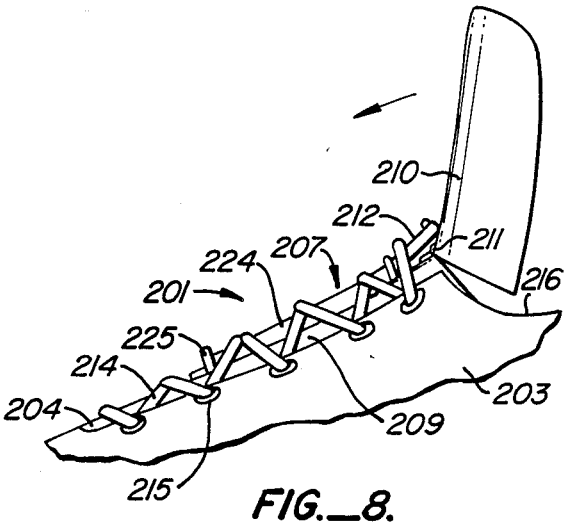
FIG. 8 is a partial side elevational view of a shoe including a dynamic fitting system constructed in accordance with another embodiment of the present invention.
Figure 11:
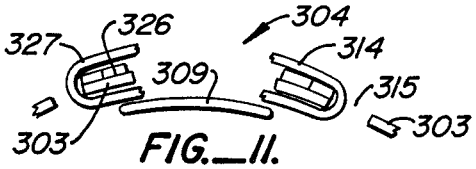
FIG. 11 is a cross-sectional view taken along line B—B of FIG. 10.
Figure 9:
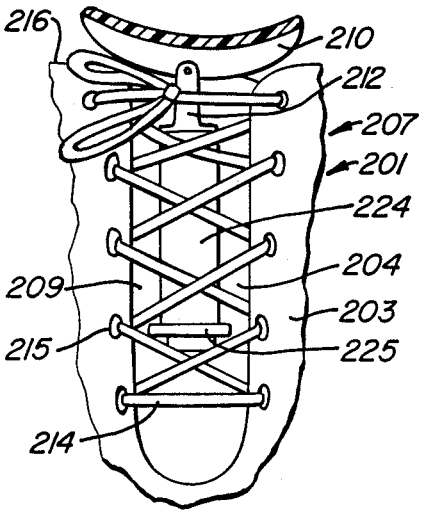
FIG. 9 is a partial top view of the shoe of FIG. 8.

Referring to FIGS. 8 and 9, a sport shoe 201 such as a tennis shoe has an upper shell 203 constructed of a flexible material such as leather and secured to the lower sole and defining the inside of the shoe in which the user places her/his foot. The upper shell 203 of the shoe includes a conventional, typically V-shaped cutout 204 above the midfoot 205 and extending generally from about the instep 207 of the midfoot 205 towards the toe end of the shoe 201. A lower tongue 209 which overlies the foot underlies the cutout and is secured to an upper tongue 210, which overlies the leg at a tongue hinge 211. Overlying the lower tongue 209 is a tightening member 212 which is, slidably coupled with the upper tongue 210 at the rearward end of tightening member 212. The V-shaped cutout may be closed by a lace 214 passing through eyelets 215 arranged in the conventional manner. A distensible bladder 224 filled with fluid such as freon or oil is positioned under lace 214 between the end of tightening member 212 and a bladder stop 225 secured to the lower tongue 209.

In use, the foot is initially placed inside the shoe 201 in a plantar flexed position and the lace 214 is adjusted and tied to provide a close fit on the foot, with the tightening member in the rearward position, and to prevent a loosening of the fit from the close fit condition. When the user forward flexes her/his leg relative to the foot, the tightening member 212 moves in a forward direction causing upward and outward distortion of bladder 224 resulting in increased tightness of the lace 214 and upper shell 3 on the foot.

Figure 10:
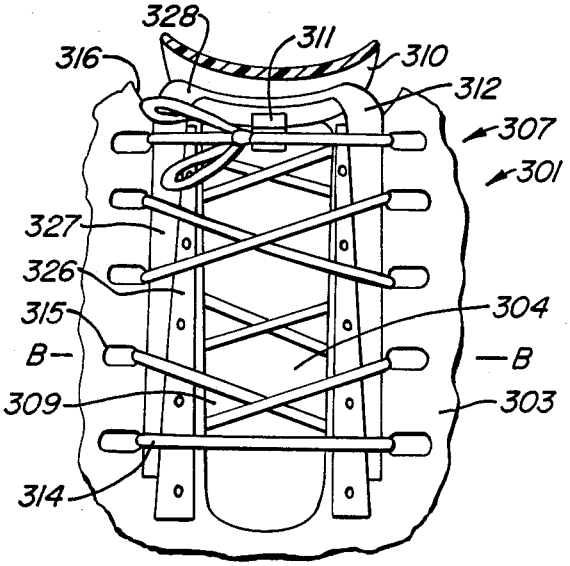
FIG. 10 is a partial top view of a shoe including a dynamic fitting system constructed in accordance with another embodiment of the present invention.

Referring to FIG. 10, a sport shoe 301 has an upper shell 303 constructed of a flexible material such as nylon secured to the lower sole and defining the inside of the shoe within which the user places her/his foot. The upper shell of the shoe includes a cutout 304 above the midfoot 305 and extending generally from about the instep 307 of the midfoot 305 towards the toe end of the shoe 301. A lower tongue 309 which overlies the foot underlies the cutout and is secured to an upper tongue 310, which overlies the lower leg, at the tongue hinge 311. The V-shaped cutout 304 may be closed by a lace 314 passing through eyelets 315 arranged in the conventional manner. Upper shell wedges 326 are secured to the upper shell 303 adjacent to each side of cutout 304 between the upper shell 303 and lace 314 by rivets or the like. Tightening member 312 is coupled to upper tongue 310 and includes a slightly flexible tightening member yoke 327 and tightening member wedges 328 which are slidably positioned between upper shell wedges 326 and eyelets 315 and between shell 303 and lace 314.

In use, the foot is initially placed inside of the shoe 301 in a plantar flexed position and the lace 314 is adjusted and tied to provide a close fit on the foot with the tightening member in a rearward position and to prevent loosening of the fit from the close fit condition. When the user forward flexes her/his leg relative to the foot, the tightening member 312 moves in a forward direction causing the tightening member wedges 328 to slide forward relative to upper shell wedges 326 causing the tightening member wedges 326 to move toward each other narrowing the cutout and tightening the shell and shoe on the foot.

Details have been disclosed to illustrate the invention in the preferred embodiment in which adaptions and modifications in the spirit and scope of the invention will occur to those skilled in the art. The scope of the invention is limited only by the following claims.

I claim:

1. A sport shoe comprising a sole and a relatively flexible upper adapted to enclose a foot of a user of the shoe, first tongue means adapted to be disposed between the foot and the upper, second tongue means adapted to engage a portion of a leg of the user, movement means interconnecting the first and second tongue means and permitting movement of the second tongue means relative to the first tongue means in response to relative movements between the user's foot and leg, and tightening means operatively coupled with the first and second tongue means for increasing the tightness with which the user's foot is enclosed by the shoe in response to a predetermined relative movement between the user's foot and leg.

2. A sport shoe according to claim 1 wherein the first tongue means engages an upper surface of said foot.

3. A sport shoe according to claim 1 where the first tongue means is pivotably secured to the second tongue means.

4. A sport shoe according to claim 1 wherein the first tongue means comprises a lower tongue.

5. A sport shoe according to claim 4 wherein the second tongue means comprises an upper tongue.

6. A sport shoe according to claim 5 wherein said tightening means is movably coupled to said upper tongue.

7. A sport shoe according to claim 6 wherein said tightening means is pivotably coupled to said upper tongue.

8. A sport shoe according to claim 5 wherein said tightening means slidably engages said upper tongue.

9. A sport shoe according to claim 6 wherein said tightening means slidably engages said lower tongue.

10. A sport shoe according to claim 9 including a wedging member cooperating with the tightening means for moving the tightening means to increase the tightness with which the upper encloses the user's foot.

11. A sport shoe according to claim 10 wherein said wedging member is secured to the first tongue means.

12. A sport shoe according to claim 1 including means for adjusting the tightening means relative to the second tongue means.

13. A sport shoe according to claim 1 wherein the shoe includes lacing and wherein said tightening means includes at least one hook to engage said shoe lacing.

14. A sport shoe according to claim 1 including means for pivotably coupling the tightening means to the first tongue means.

15. A sport shoe according to claim 1 wherein said tightening means includes at least one distensible bladder.

16. A sport shoe according to claim 1 wherein the tightening means includes means for increasing the tightness with which the shoe encloses the foot in response to a forward movement of the user's leg relative to the foot.

17. A sport shoe according to claim 1 wherein the movement means includes means permitting hingeable movements of the second tongue means relative to the first tongue means.

18. A sport shoe according to claim 1 wherein the first tongue means comprises tongue means formed to overlie an instep portion of the user's foot.

19. A sport shoe according to claim 18 wherein the upper includes a generally V-shaped cutout and lacing engaging the upper and extending across the cutout, and wherein the tightening means is supported by the tongue means and is positioned to engage the lacing and tighten the lacing when the second tongue means moves relative to the tongue.

20. A sport shoe comprising a sole, an upper formed to overlie a user's foot including a generally V-shaped cutout defined by opposing cutout edges of the upper, lacing engaging the upper in the vicinity of the cutout adapted for pulling the cutout edges towards each other to thereby tighten the upper over the user's foot; first tongue means generally between the lacing and the user's foot; second tongue means attached to the first tongue means, generally hingeably movable relative thereto and formed to be engaged by a leg of the user; and a tightening member generally disposed between the first tongue means and the lacing and operatively coupled to the first and second tongue means so that relative hingeable movements between the first and second tongue means in a first direction causes the lacing to pull the cutout edges towards each other with an increased force to thereby momentarily increase the tightness with which the user's foot is engaged by the shoe until the tongue means hingeably moves in a second, generally opposite direction to decrease the force with which the lacing pulls the cutout edges towards each other to correspondingly decrease the tightness with which the shoe engages the user's foot.

21. A sport shoe according to claim 20 wherein the tightening member comprises third tongue means hingeably attached to one of the first and second tongue means, and means for moving the third tongue means generally away from the other one of the first and second tongue means when the first and second tongue means hingeably move relative to each other in the first direction.

22. A sport shoe according to claim 21 wherein the means for moving the third tongue means away from the other one of the tongue means comprises means for moving the third tongue means away from the other one of the tongue means in response to a forward pivotal movement of the user's leg relative to his foot.

23. For use with a sport shoe having a sole, an upper including a generally V-shaped cutout, and lacing means extending across the cutout, the upper and the lacing means being formed to fit over a user's foot, a device for tightening the fit of the shoe on the user's foot, comprising first tongue means shaped to engage an instep portion of the user's foot adapted to be placed between the foot and the lacing means, second tongue means adapted to be engaged by a leg attached to the user's foot; means interconnecting the first and second tongue means and permitting relative hingeable movements therebetween; a tightening member secured to one of the tongue means and adapted to be positioned between the first tongue means and the lacing means; and actuating means attached to the other one of the tongue means, engaging the tightening member, and moving the tightening member generally away from the first means when the first and second tongue means are hingedly moved relative to each other in a first direction; whereby hingeable movements between the first and second tongue means in the first direction momentarily increase the tightness with which the upper and the lacing means engage the foot when the tightening device is inserted in a shoe and hingeable movements between the first and second tongue means in a second opposite direction correspondingly decrease the tightness with which the upper and the lacing means engage the foot.

24. A sport shoe for momentarily increasing the tightness with which the shoe engages a user's foot as a function of predetermined relative movements between the user's foot and an associated leg, the shoe comprising a sole, a relatively flexible upper including a cutout bound by cutout edges defined by the upper, lacing means extending across the cutout and engaging the upper in the vicinity of the cutout edges for adjusting and setting the tightness with which the shoe encloses the foot, a first tongue generally disposed between the lacing means and an instep portion of the user's foot, a second tongue secured to the first tongue and adapted to be engaged by the user's leg, means movably connecting the first and second plates so that the tongues can move relative to each other in correspondence with relative movements between the user's foot and leg, a tightening member generally disposed between the lacing means and the first tongue, means constraining the tightening member to one of the first and second tongues and permitting movement of the member relative thereto, ramp means defined by the other one of the first and second tongues and by the tightening member for moving the tightening member generally away from the first tongue in response to a predetermined relative movement between the first and second tongues in a first direction to thereby increase a distance between the first tongue and the lacing means and correspondingly increase the tightness with which the shoe encloses the user's leg until the first and second tongues are moved in a second, opposite direction and the tightening member is moved towards the first tongue.

* * * * *